US008165335B2

(12) United States Patent
Hayasaka et al.

(10) Patent No.: US 8,165,335 B2
(45) Date of Patent: Apr. 24, 2012

(54) SPEAKER AND SPEAKER UNIT

(75) Inventors: Shinichi Hayasaka, Tendo (JP); Koji Takayama, Tendo (JP); Hiroyuki Kobayashi, Tendo (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 1287 days.

(21) Appl. No.: 11/646,513

(22) Filed: Dec. 28, 2006

(65) Prior Publication Data

US 2007/0189573 A1 Aug. 16, 2007

(30) Foreign Application Priority Data

Dec. 28, 2005 (JP) ..... 2005-379949

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 25/00*** | (2006.01) |
| ***H04R 1/02*** | (2006.01) |

(52) U.S. Cl. ..... 381/396; 381/150; 381/389; 381/397; 381/433

(58) Field of Classification Search ..... 381/397, 381/433, 389, 150, 396

See application file for complete search history.

(56) References Cited

U.S. PATENT DOCUMENTS

| | | | | |
|---|---|---|---|---|
| 5,802,191 | A * | 9/1998 | Guenther | 381/386 |
| 5,909,015 | A * | 6/1999 | Yamamoto et al. | 181/156 |
| 6,675,930 | B2 * | 1/2004 | Sugiyama et al. | 181/148 |

FOREIGN PATENT DOCUMENTS

JP 2004-187173 A 7/2004

* cited by examiner

*Primary Examiner* — Davetta W Goins
*Assistant Examiner* — Matthew Eason
(74) *Attorney, Agent, or Firm* — Sughrue Mion, PLLC

(57) ABSTRACT

The present invention is to provide a speaker having desirable sound characteristics with a smaller size, and a speaker unit having the speaker. The speaker unit has the speaker and an attachment unit. The speaker has a case, a magnetic circuit, a diaphragm, and a passage. A first chamber is disposed between an inner surface of an outer case of the case and an outer surface of the magnetic circuit. A second chamber is disposed between the diaphragm and the magnetic circuit. The passage communicates with the first and second chambers and has a groove disposed on a bottom wall of the case.

8 Claims, 6 Drawing Sheets

SPEAKER AND SPEAKER UNIT

BACKGROUND OF THE INVENTION

1. Field of the Invention

The present invention relates to a speaker and a speaker unit having the speaker mounted on a vehicle such as a motor vehicle and a vessel.

2. Description of the Related Art

The vehicle such as the motor vehicle and vessel is equipped with a speaker to output various types of sound information, for example, refer to JP,2004-187173,A. The speaker includes a case to be attached to a structure, a magnetic circuit received in the case, and a diaphragm for generating sound driven by the magnetic circuit. A signal current is supplied to a voice coil disposed in a magnetic gap so as to vibrate the diaphragm and generate sound.

The conventional speaker has a chamber therein, which vibrates the air vibrated with the diaphragm, to achieve a desired sound characteristics. JP,2004-187173,A discloses that the chamber is disposed behind the diaphragm and overlapped with the diaphragm and the magnetic circuit along an axis thereof.

When the chamber is disposed in the speaker, the speaker becomes thick along a direction of thickness. The case including the speaker becomes large and is not appreciated for attaching to the structure.

SUMMARY OF THE INVENTION

An object of the present invention is to provide a speaker and a speaker unit having a small size speaker with a desired sound characteristic.

According to a first aspect of the present invention, a speaker includes a case having a bottom wall and a peripheral plate; a magnetic circuit received in the case and disposed on a bottom wall of the case; a diaphragm vibrated by the magnetic circuit for generating sound; a first chamber disposed between an inner surface of the case and an outer surface of the magnetic circuit; a second chamber disposed between the diaphragm and the magnetic circuit; and a passage communicating with the first and second chambers.

Preferably, the passage has a groove formed in at least one of the bottom wall of the case and the bottom plate of the magnetic circuit.

Preferably, the bottom wall of the case has a circular shape in plan view, the bottom plate of the magnetic circuit has an annular shape in plan view, the bottom wall and bottom plate are disposed coaxially, and the groove extends radially from the centers of the bottom wall and bottom plate.

Preferably, a plurality of the grooves are disposed radially and spaced each other.

Preferably, the groove has a gradually wider width toward the peripheral plate of the case.

Preferably, the magnetic circuit has an annular shape, and the case has a cylindrical shaped boss upstanding from the bottom wall thereof and spaced from an inner surface of the magnetic circuit, the boss being tapered toward the diaphragm.

Preferably, the boss has a dome shaped surface at an end portion thereof.

Preferably, the boss has an opening at an outer surface of the bottom wall of the case and a screw bore for accepting an attachment unit utilized for attaching the speaker to a structure.

According to a second aspect of the present invention, a speaker unit includes the speaker and the attachment unit for attaching the speaker to the structure, the attachment unit being attached to the case with the screw bore.

DETAILED DESCRIPTION OF THE PREFERRED EMBODIMENTS

Figure 1:
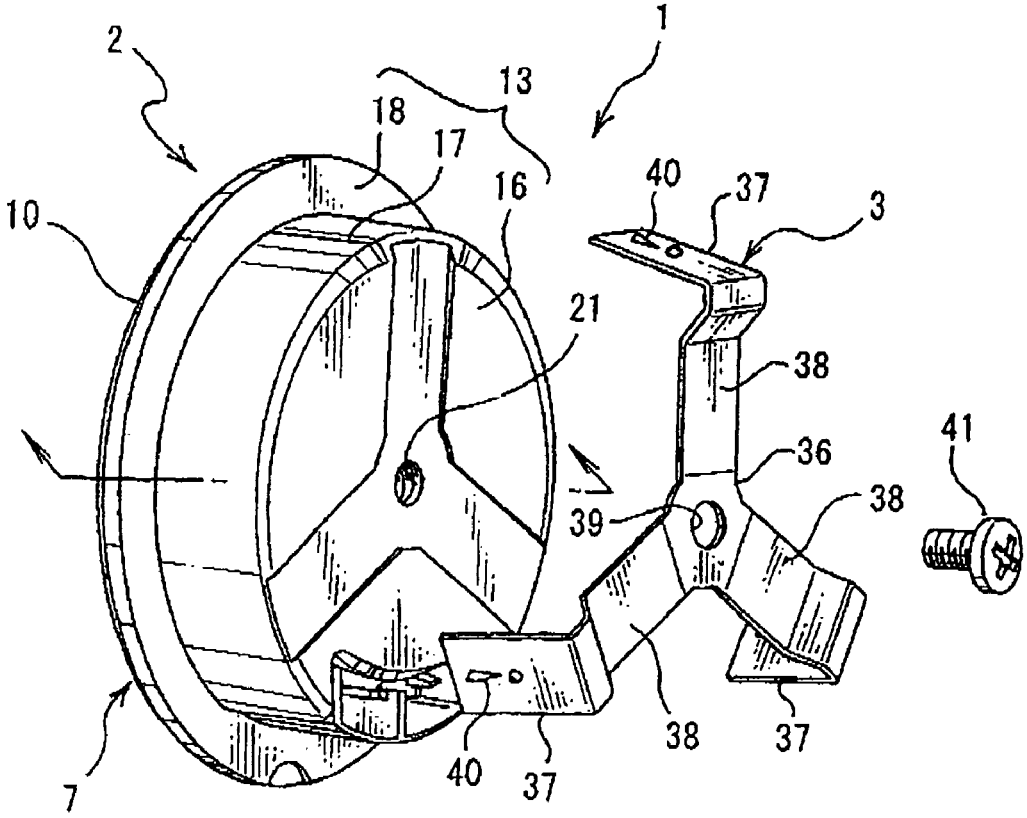
FIG. 1 is an exploded perspective view of an embodiment of a speaker unit of the present invention.
Figure 2:
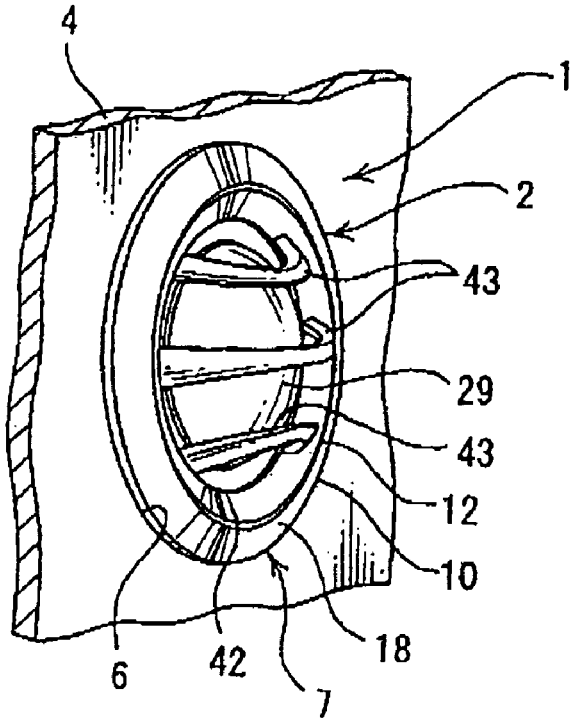
FIG. 2 is a perspective view showing the speaker unit of FIG. 1 attached to a dashboard.
Figure 3:
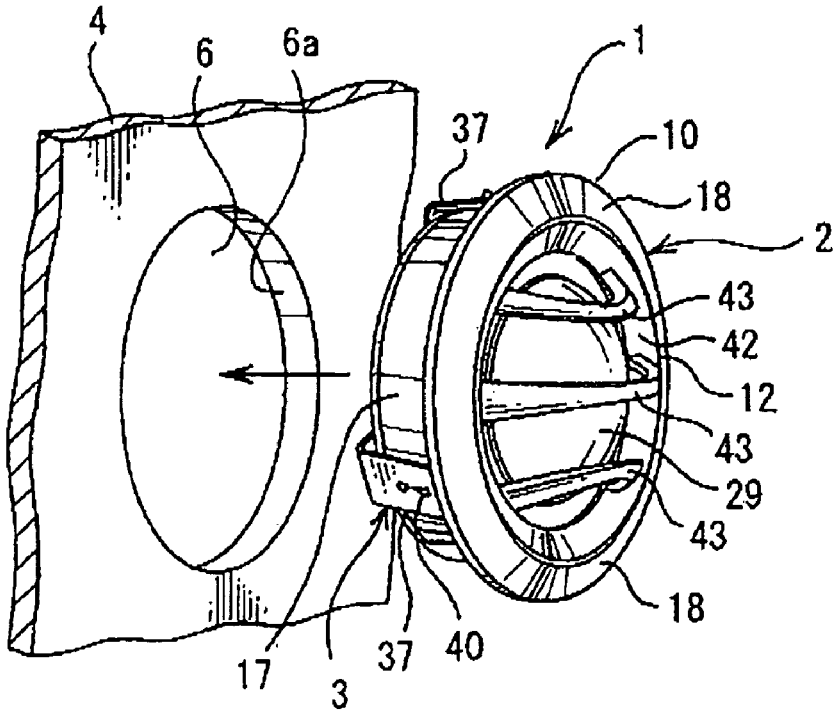
FIG. 3 is a perspective view showing the speaker unit detached from the dashboard.

A first embodiment of the present invention is explained by referring to FIGS. 1-6. Referring to FIGS. 1 and 3, a speaker unit 1 includes a speaker 2 and an attachment unit 3. The speaker unit 1 is attached to a dashboard 4, in FIGS. 2 and 3, in a passenger compartment of a motor vehicle.

As shown in FIGS. 2 and 3, the dashboard 4 has a circular opening 6. An inner diameter of the opening 6 is slightly smaller than an outer diameter of a flange 18 of the speaker 2 and slightly smaller than an outer diameter of a plurality of resilient portions 37 of the attachment unit 3 prior to the attachment of the speaker unit 1 to the dashboard 4. An inner surface 6*a* of the opening 6 is formed flat.

Figure 4:
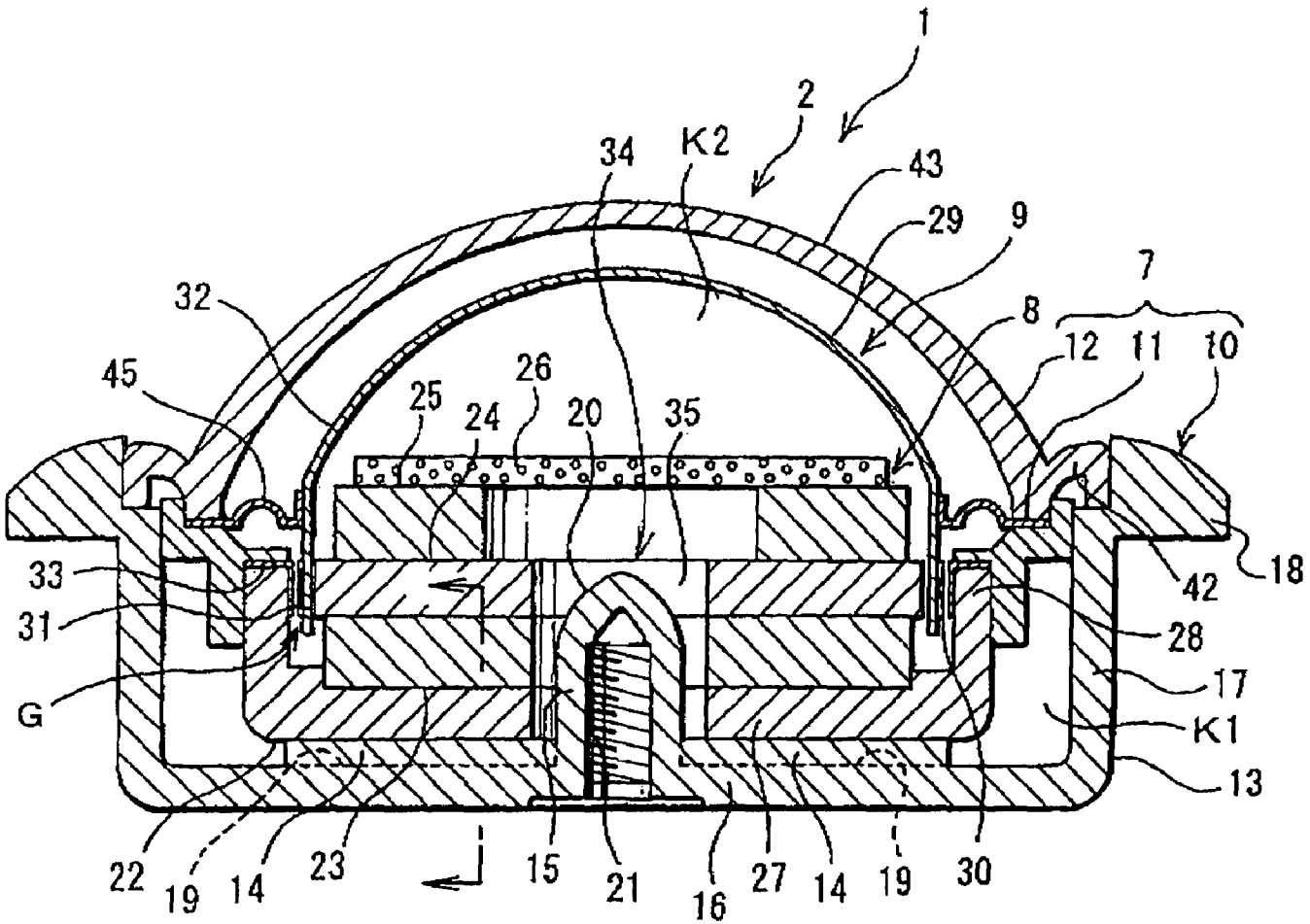
FIG. 4 is a sectional view taken along line IV-IV of FIG. 1.

As shown in FIG. 4, the speaker 2 includes a case 7, a magnetic circuit 8 received in the case 7, and a diaphragm portion 9. The case 7 has an outer case 10, a holder 11, an outer edge 12, and a copper ring 33.

Figure 6:
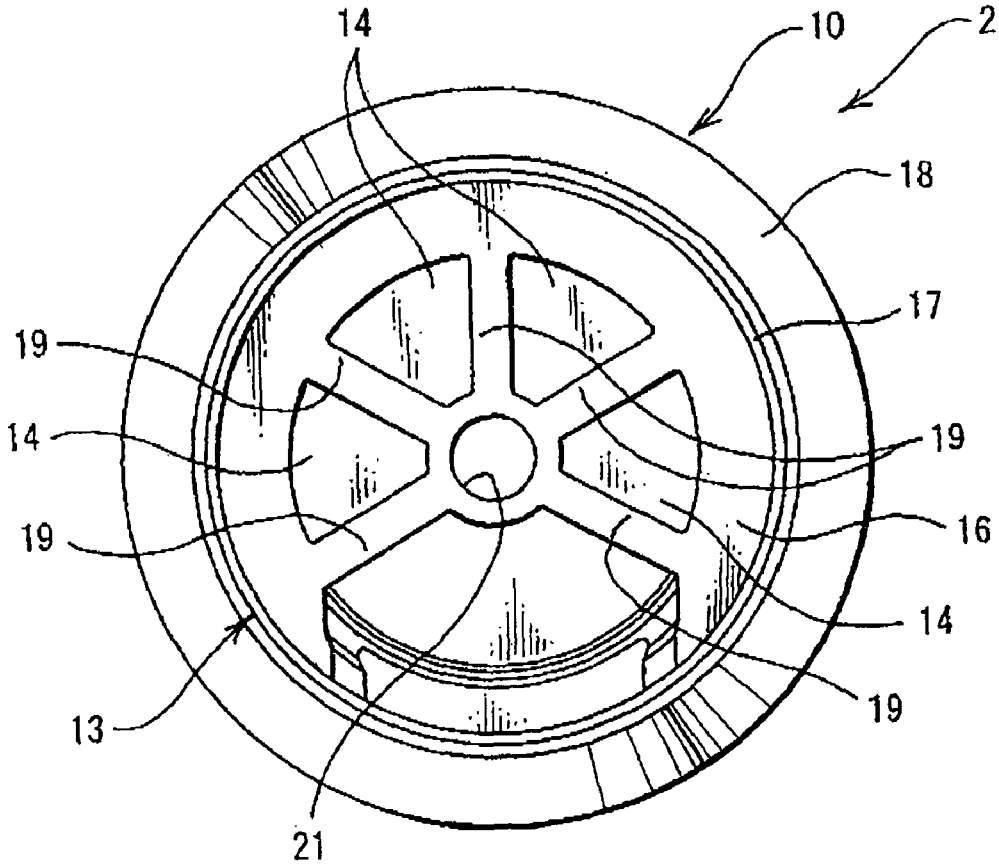
FIG. 6 is a plan view of an outer case of a case of the speaker of FIG. 4.

As shown in FIGS. 4 and 6, the outer case 10 has a main body 13, a plurality of support projections 14, and a boss 15. The main body 13 has integrally a bottom wall 16, a peripheral plate 17 upstanding from an outer edge of the bottom wall 16, and the flange 18.

The bottom wall 16 has a disk shape. The peripheral plate 17 has a tube shape and is coaxial with the bottom wall 16. The flange 18 has an annular shape and is disposed at an upper edge of the peripheral plate 17 and is coaxial with the peripheral plate 17 and bottom wall 16.

The plurality of the support projections 14 are disposed on the bottom wall 16 of the main body 13 and arranged radially with an equal spacing each other. One of the support projections 14 has a wide fan shape and the others have a narrow fan shape. Upper surfaces of the support projections 14 are flat and parallel to an upper surface of the bottom wall 16 of the case 7. The bottom wall 16 of the case 7 thus has a circular shape.

Figure 5:
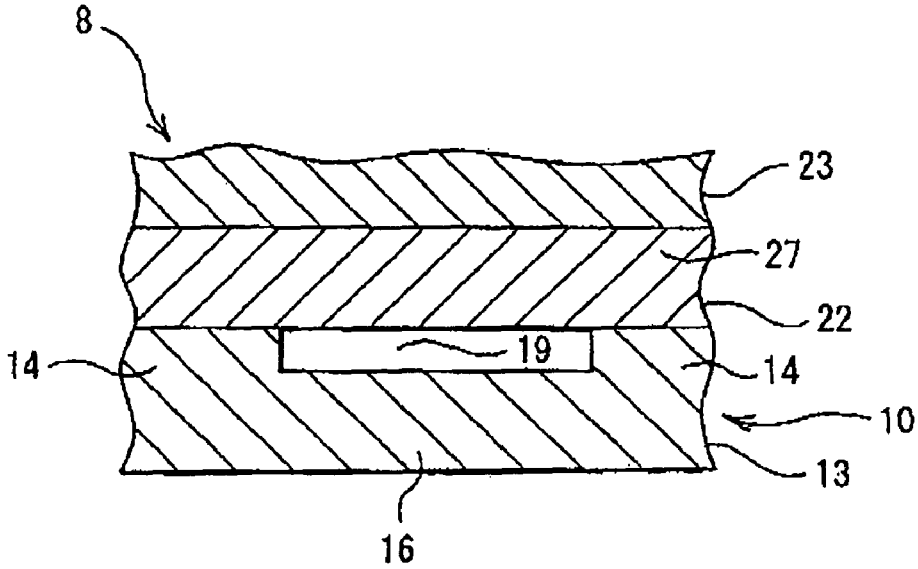
FIG. 5 is a sectional view taken along line V-V of FIG. 4.

The adjacent support projections 14 have a groove 19 therebetween as shown in FIGS. 5 and 6. The plurality of the grooves 19 extend in a radial direction from the centers of the bottom wall 16 of the case 7 and a bottom plate 27 of the magnetic circuit 8.

The plurality of the grooves 19 have a same width and are disposed radially and spaced each other. The magnetic yoke 22 of the magnetic circuit 8 is attached to the support projections 14. The bottom wall 16 of the case 7 and the yoke 22 are coaxial.

The boss 15 has a cylindrical shape, and is upstanding inwardly from the center of the bottom wall 16 and coaxial with the outer case 10. The boss 15 has a dome shaped surface 20 at an end thereof opposite to the bottom wall 16 of the main body 13. A vertical cross-section of the boss 15 is thus tapered toward the diaphragm portion 9.

The boss 15 is spaced from an inner surface of the yoke 22, an inner surface of a first magnet 23, an inner surface of a yoke plate 24, and an inner surface of a second magnet 25.

The boss 15 has a screw bore 21. The screw bore 21 is coaxial with the boss 15 and has an opening at one end at an outer surface of the bottom wall 16 and is closed at the other end thereof. The attachment unit 3 is attached to the case 7 with a screw 41, which enters into a bore 39 and screws into the screw bore 21.

The holder 11 has an annular shape and has an outer diameter nearly equal to an inner diameter of the peripheral plate 17 of the main body 13. The holder 11 is attached to the upper edge of the peripheral plate 17 and holds the magnetic circuit 8 by clipping a peripheral wall 28 of the yoke 22.

The outer edge 12 has an edge portion 42 and a plurality of connection portions 43. The edge portion 42 has an annular shape and an outer diameter nearly equal to the inner diameter of the flange 18 and an inner diameter smaller than the outer diameter of the holder 11. The connection portions 43 have a rod shape and are juxtaposed to each other in the edge portion 42 and are arcuated outwardly.

The outer edge 12 is attached to the outer case 10 with the edge portion 42 disposed at an inner surface of the flange 18. The outer edge 12 secures the holder 11 to the outer case 10 by clipping the holder 11 between the edge portion 42 and the peripheral wall 28 of the yoke 22.

The copper ring 33 is made of copper or a copper alloy and has an annular shape. The copper ring 33 is disposed between the holder 11 and the peripheral wall 28 of the yoke 22 and fixed to the case 7.

The magnetic circuit 8 has the magnetic (paramagnetic or ferromagnetic material) yoke 22, the first magnet 23, the magnetic (paramagnetic or ferromagnetic material) yoke plate 24, the second magnet 25, and a sound absorption sheet 26.

The yoke 22 integrally has the annular bottom plate 27 and the peripheral wall 28 upstanding from the bottom plate 27 which are coaxial. The bottom plate 27 has an outer diameter smaller than the outer diameter of the bottom wall 16 of the case 7 and an inner diameter larger than an outer diameter of the boss 15. The yoke 22 allows the boss 15 to enter through the center there of. The bottom plate 27 of the yoke 22 is disposed on the bottom wall 16 of the outer case 10. The peripheral wall 28 is disposed between the bottom wall 16 and the holder 11.

The bottom plate 27 has a lower surface, which is opposed to the diaphragm, having a flat and annular shape.

The first magnet 23 has an annular shape and is a permanent magnet or a magnet energized with a direct current. The first magnet 23 has an outer diameter smaller than an inner diameter of the peripheral wall 28 of the yoke 22 and an inner diameter larger than the outer diameter of the boss 15. The first magnet 23 allows the boss 15 to enter through the center thereof. The first magnet 22 is disposed on the bottom plate 27 of the yoke 22.

The yoke plate 24 has an annular shape and an outer diameter smaller than the inner diameter of the peripheral wall 28 and an inner diameter larger than the outer diameter of the boss 15. The yoke plate 24 allows the boss 15 to enter through the center thereof and is disposed on the first magnet 23.

The second magnet 25 has an annular shape and is a permanent magnet or a magnet energized with a direct current. The second magnet 25 has the outer diameter smaller than the inner diameter of the peripheral wall 28 of the yoke 22 and an inner diameter larger than the outer diameter of the boss 15. The second magnet 25 is disposed on the yoke plate 24.

The sound absorption sheet 26 is formed from a perforated material and has a disk shape and has an outer diameter smaller than the inner diameter of the peripheral wall 28 and is disposed on the second magnet 25.

The yoke plate 24, sound absorption sheet 26, first and second magnets 23, 25, and yoke 22 are secured to each other with an adhesive agent or a combination of the adhesive agent and a bolt (not shown). The peripheral wall 28 of the yoke 22 is held between the bottom wall 16 and the holder 11.

The magnetic circuit 8 includes the yoke plate 24, sound absorption sheet 26, first and second magnets 23, 25, and yoke 22, which are coaxial each other, and has an annular shape as a whole and is received in the case 7. An outer surface of the yoke plate 24 is spaced from an inner surface of the peripheral wall 28 of the yoke 22. The inner surfaces of the yoke plate 24, the first and second magnets 23, 25, and the yoke 22 define an inner surface of the magnetic circuit 8.

The inner surface of the peripheral wall 28 and the outer surface of the yoke plate 24 form a magnetic gap G to drive a diaphragm 29 in cooperation with a voice coil 30. When the magnetic circuit 8 is attached to the case 7, the magnetic circuit 8 defines a first chamber K1 between an outer surface thereof 8 and an inner surface of the outer case 10.

The diaphragm portion 9 has the diaphragm 29, the voice coil 30, and an edge 45. The diaphragm 29 has a bobbin 31 and a sound generating portion 32. The bobbin 31 has a tube shape and is disposed in the magnetic gap G and is spaced from the copper ring 33 and the yoke plate 24.

The sound generating portion 32 has a bowl shape and extends toward the speaker 2 and vibrates as the diaphragm 29 along an axis of the magnetic circuit 8 to generate the sound.

The diaphragm 29 is supported with the edge 45 held by the case 7 and movable along the axis of the magnetic circuit 8. The diaphragm 29 is disposed spaced from the magnetic circuit 8 and defines a second chamber K2.

The voice coil 30 is attached to an outer surface of the bobbin 31 and disposed in the magnetic gap G and provided with a signal current. The edge 45 has an annular shape and is resilient. An inner edge of the edge 45 is attached to the diaphragm 29 and an outer edge thereof is interposed between the holder 11 and the outer edge 12 of the case 7. The edge 45 allows the diaphragm 29 to vibrate along the axial direction of the magnetic circuit 8 and to attenuate the vibration. The diaphragm portion 9 including the diaphragm 29 and the voice coil 30 is coaxial with the magnetic circuit 8.

The first and second chambers K1 and K2 are communicated with a passage 34 in the speaker 2. The passage 34 includes the plurality of the grooves 19, which communicates with the first chamber K1, and a clearance 35, which is disposed between an outer surface of the boss 15 and the inner surface of the magnetic circuit 8, communicated with the second chamber K2 and the grooves 19.

The attachment unit 3 is formed by punching and bending a metal plate. As shown in FIG. 1, the attachment unit 3 integrally has an attachment portion 36 with a flat plate and a plurality (three in FIG. 1) of the resilient portions 37.

The attachment portion 36 has a plurality of straight rectangular plates 38 (three in FIG. 1) extending radially and equally spaced each other. The bore 39 is disposed at the center of the attachment portion 36.

The resilient portions 37 have a flat belt shape and are connected integrally with the attachment portion 36.

The resilient portions 37 are sloped about an axis of the attachment unit 3 and spaced away from the axis toward ends thereof 37 to be attached to the speaker 2. Each resilient portion 37 has a projection 40 extending outwardly from therefrom.

The attachment unit 3 is attached to the speaker 2 and the screw 41 is screwed into the screw bore 21 through the bore 39 of the attachment unit 3. The attachment portion 36 thus abuts on the bottom wall 16 of the case 7. The assembled speaker unit 1 is then inserted into the opening 6 of the dashboard 4 along a direction denoted by an arrow in FIG. 3.

When the speaker unit 1 is inserted into the opening 6, ends of the resilient portions 37 resiliently deform toward the peripheral plate 17. The speaker unit 1 is press-fitted until the flange 18 abuts on the dashboard 4. The resilient portions 37 are urged toward the inner surface 6*a* of the opening 6, and the projections 40 penetrate into the inner surface 6*a* so that the speaker unit 1 is secured to the dashboard 4.

In the assembly of the speaker unit 1, the signal current is supplied to the voice coil 30 of the speaker 2 to vibrate the diaphragm 29, especially the sound generating portion 32 responsive to the signal current, and generate the sound. The vibration of the diaphragm 29 generates an air flow to the first and second chambers K1 and K2 through the passage 34.

The first chamber K1 is disposed between the inner surface of the outer case 10 and an outer surface of the peripheral wall 28 of the magnetic circuit 8 and has a larger space than such a case that the first chamber K1 is disposed along the axis of the magnetic circuit 8. The passage 34 prevents an increase of a thickness in the axial direction of the magnetic circuit 8. The first and second chambers K1 and K2 are communicated each other so that the vibration of the diaphragm 29 transmits to the first chamber K1 having the large space. The present invention thereby reduces the size of the speaker unit and achieves desired sound characteristics.

The passage 34 has the plurality of the grooves 19 disposed on either the bottom wall 16 of the case 7 or a lower surface of the magnetic circuit 8 to communicate between the first and second chambers K1 and K2 so as to prevent the increase of the thickness in the axial direction of the speaker unit 1.

This is because that the grooves 19 are radially disposed on either the bottom wall 16 of the case 7 or the lower surface of the magnetic circuit 8.

The grooves 19 are arranged equally spaced so that the air moves easily between the first and second chambers K1 and K2 and provides the desired sound characteristics.

The boss 15 is upstanding from the bottom wall 16 of the case 7 and spaced from the inner surface of the magnetic circuit 8 and tapered toward the second chamber K2 and has the curved surface 20. The boss 34 thereby prevents a turbulent flow of the air flowing in and out of the second chamber K2 so that the speaker unit 1 achieves the desired sound characteristics.

The boss 15 has the screw bore 21 to accept the attachment unit 3 so that the case 7 can be made smaller.

The speaker unit 1 thus becomes smaller with the desired sound characteristics so that the small size speaker unit is attained.

Figure 7:
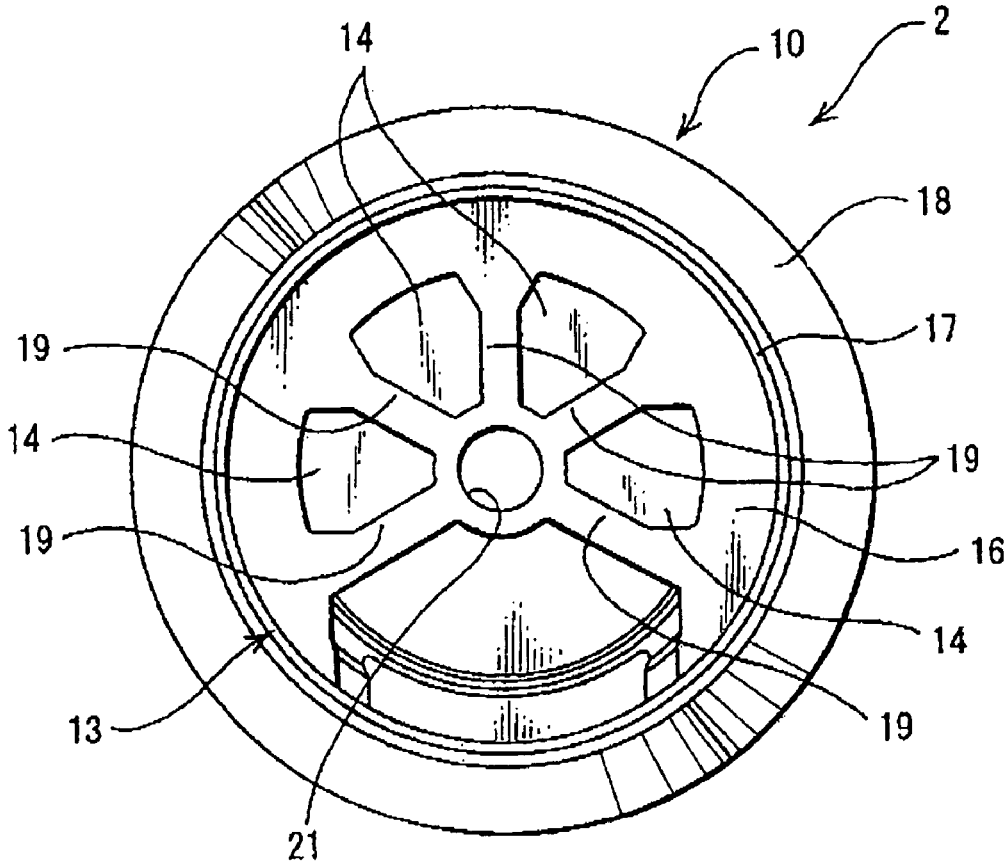
FIG. 7 is a plan view of a modified outer case of FIG. 6.

In the above embodiment, the grooves 19 have the same width along the whole length. As shown in FIG. 7, the width thereof can be varied. The width of each groove 19 becomes wider toward the radial direction thereof. The configuration of the grooves 19 prevents the turbulent air flow into and out of the first chamber K1 and the air can easily flow between the first and second chambers K1 and K2 so that the speaker unit 1 achieves the desired sound characteristics.

Figure 8:
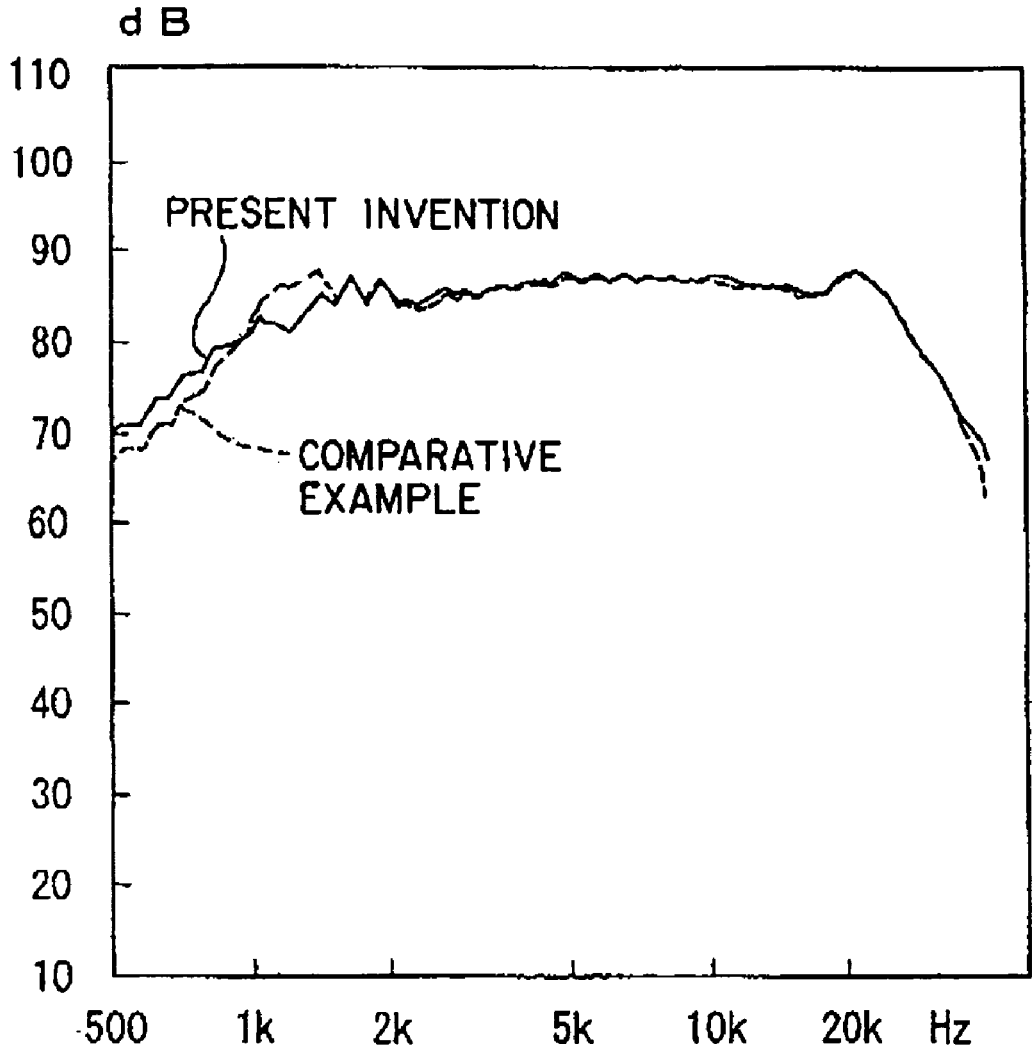
FIG. 8 illustrates sound characteristics between the present invention and a comparative example.

FIG. 8 shows the sound characteristics of the embodiment of the speaker 2 of the present invention. The abscissa axis is frequency of sound and the ordinate axis is output of sound pressure level. Data of a comparative example are obtained from a speaker without the grooves 19.

As seen in FIG. 8, the speaker of the present invention has a higher output by 2-4 dB in the frequency range of 500 Hz-1 KHz than the comparative example.

Preferably, the grooves 19 can be disposed on the lower surface of the bottom plate 27 of the yoke 22 or the grooves 19 can be disposed on at least one of the bottom wall of the case 7 and the bottom plate 27 of the yoke 22.

Preferably, the attachment unit 3 has two resilient portions 37 formed by punching a metal plate so that the material yield increases. It is desirable to arrange the straight plate 38 to align with the resilient portions 37.

It is desirable that the resilient portions 37 are arranged equally spaced around the peripheral plate 17 of the case 7. Preferably, the attachment unit 3 may have any number of the resilient portions 37.

Preferably, the speaker 2 can be attached to a structure other than the dashboard 4 of the motor vehicle or can be attached to a variety of structures other than the motor vehicle.

According to the embodiment of the present invention, the following speaker is attained.

The first chamber K1 is disposed between the inner surface of the outer case 10 of the case 7 and the outer surface of the magnetic circuit 8 so that the first chamber K1 is capable of having the larger space than when the first chamber K1 is disposed between the magnetic circuit 8 and the axis thereof. The formation of the passage 34 prevents the increase of the thickness of the speaker unit 1 in the axial direction. The communication between the first and second chambers K1 and K2 allow the vibration of the air with the diaphragm 29 to propagate to the first chamber K1 having the large space. The speaker unit 1 accordingly can be minimized and attains the desired sound characteristics.

The embodiment of the present inventions are only exemplary and not limited thereto. Any modifications of the present invention are within the scope of the present invention.

What is claimed is:

1. speaker comprising:

a magnetic circuit including a yoke having a substantially cylindrical peripheral wall extended vertically from a bottom plate;

a diaphragm vibrated by the magnetic circuit for generating sound;

a case having a substantially cylindrical peripheral plate vertically extended from a bottom wall and surrounding the peripheral wall with a specific gap;

a first chamber disposed between an inner peripheral wall of the peripheral plate and the peripheral wall;

a second chamber disposed between the diaphragm and the magnetic circuit;

a passage communicating with the first and second chambers, wherein the first and the second chamber are one closed space substantially; and wherein a lower surface of the bottom plate and an upper surface of the bottom wall contact each other, the passage has a groove formed in at least one of the bottom surface and the upper surface.

2. The speaker as claimed in claim 1, wherein the bottom wall has a circular shape in plain view, the bottom plate has an annular shape in plain view, the bottom wall and the bottom plate are disposed coaxially, and the groove extends toward an outer periphery from the centers of the bottom wall and bottom plate.

3. The speaker as claimed in claim 2, wherein a plurality of the grooves are disposed in a circumferential direction of the bottom wall and the bottom plate.

4. The speaker as claimed in claim 2, wherein the groove has a gradually wider width toward the outer periphery of the bottom wall and the bottom plate.

5. The speaker as claimed in claim 1, wherein the magnetic circuit has an annular shape, and the case has a cylindrical shaped boss upstanding from the bottom wall and spaced from an inner surface of the magnetic circuit, the boss being tapered toward the diaphragm.

6. The speaker as claimed in claim 5, wherein the boss has a dome shaped surface at an end portion thereof.

7. The speaker as claimed in claim 5, wherein the boss has an opening at an outer surface of the bottom wall of the case and a screw bore for accepting an attachment unit utilized for attaching the speaker to a structure.

8. A speaker unit comprising:

the speaker as claimed in claim 7; and the attachment unit for attaching the speaker to the structure, the attachment unit being attached to the case with the screw bore.

* * * * *